United States Patent [19]

St. Cyr

[11] 4,258,502

[45] Mar. 31, 1981

[54] MOVING AUTOMATED TOLL COLLECTORS

[76] Inventor: Napoleon St. Cyr, 10 Overland Dr., Stratford, Conn. 06497

[21] Appl. No.: 30,131

[22] Filed: Apr. 16, 1979

[51] Int. Cl.[3] ..... E01F 13/00

[52] U.S. Cl. ..... 49/49; 49/42; 194/DIG. 23; 194/DIG. 24; 52/174

[58] Field of Search ..... 49/49, 47, 68, 93, 94, 49/42, 46, 35; 404/6, 1, 9; 194/1 R, DIG. 23, DIG. 24; 52/174; 232/7

[56] References Cited

U.S. PATENT DOCUMENTS

| | | | |
|---|---|---|---|
| 1,665,157 | 4/1928 | Dahnke | 49/93 X |
| 3,070,293 | 12/1962 | Rosapepe | 194/DIG. 23 |

FOREIGN PATENT DOCUMENTS

| | | | |
|---|---|---|---|
| 982271 | 2/1965 | United Kingdom | 194/DIG. 24 |

*Primary Examiner*—Kenneth Downey
*Attorney, Agent, or Firm*—Cifelli & Frederick

[57] ABSTRACT

Moving automated toll collector apparatus comprises a plurality of automated toll collectors, each having a large hopper presenting a large target for receiving toll coins, driven at spaced apart intervals in a path parallel to a traffic lane of a toll station. Vehicles enter the traffic lane, take a position adjacent one of the automated toll collectors, deposit the toll and depart the toll station without stopping. This improves traffic flow through toll stations and eliminates traffic backups. Control arm units including a control arm extending across the traffic lane may be positioned ahead of each automated toll collector, the control arm unit also being driven in the path along the traffic lane. The control arm units may include signs indicating the toll due and for indicating when the toll has been received. The automated toll collectors are preferably driven about the periphery of an elongated traffic island separating two traffic lanes at speeds from approximately one to ten or twelve miles an hour. When the two traffic lanes handle traffic proceeding in opposite directions, tolls can be collected on both sides of the traffic island. Belt means driven by a variable speed motor may be used to drive the automated toll collectors.

19 Claims, 4 Drawing Figures

TOLL
25
PD
W
L

MOVING AUTOMATED TOLL COLLECTORS

BACKGROUND OF THE INVENTION

This invention relates to apparatus for collecting tolls and more particularly to moving automated toll collector apparatus which keeps traffic flowing through toll stations.

Tolls are collected from vehicles using many highways and bridges. The tolls are generally being used to pay for construction and/or maintenance of the highways and bridges upon which they are collected, and there is often a long term repayment schedule. Tolls are also used to raise revenues for other government purposes, and also in some instances to discourage vehicle traffic into congested areas. Therefore, it is unlikely that tolls and the attendant necessity of collecting them will be eliminated in the foreseeable future.

Tolls are presently collected at toll stations established at selected intervals along a highway or at approaches to bridges. The toll stations are generally comprised of a plurality of toll booths and automated toll collector machines located at fixed positions adjacent traffic lanes for passing vehicles. The toll booths are staffed by personnel who collect tolls from vehicles, and particularly those vehicles which do not have correct change, the vehicles stopping at the toll booths to make the transaction. Other traffic lanes are serviced by the automated toll collectors which receive correct change from vehicles, the vehicles stopping at the basket or hopper of the automated toll collector, depositing the toll and then departing the toll station. In some instances, an automated arm is employed to block the departure of the vehicle until the automated toll collector indicates receipt of the toll. In other instances, a red/green light signal is employed to indicate that the toll is received, and an audible signal is produced if the vehicle departs without paying the toll. Each toll station may incorporate a mixture of manned booths and automated toll collectors and typically a total of six to eight booths and automated toll collectors may be provided for three lanes of traffic.

Present toll stations are frequently inadequate to handle the volume of traffic which occurs during peak driving periods, such as during rush hours for workers traveling to and from jobs or during holiday and vacation times. Traffic backs up at toll stations, sometimes for miles during peak driving periods, simply because toll stations cannot keep up with the flow of traffic. This is a considerable inconvenience for motorists and is expensive in terms of lost man-hours that could be used productively or for leisure time. The traffic jams also waste energy, since vehicle engines are running without any useful result. Additionally, traffic jams create pollution and expose workers at toll stations and occupants of vehicles in traffic jams at toll stations to high levels of pollution. Therefore, there is a great need to expedite the collection of tolls at toll stations and to thereby avoid traffic backups.

SUMMARY OF THE INVENTION

Accordingly, the principal object of the invention herein is to improve traffic flow at toll collection stations through providing for faster collection of the tolls, thereby reducing traffic backups at the toll stations, conserving fuel, lowering pollution levels and saving motorists' time.

Collecting of tolls according to the invention herein is achieved by a plurality of spaced apart automated toll collectors moving, at a relatively low speed, parallel to a toll station traffic lane. A vehicle enters the toll station traffic lane and adjusts its speed and position to be adjacent one of the moving automated toll collectors. The toll is deposited and the vehicle exits the toll station without ever having stopped.

The automatic toll collectors are secured to a continuous loop belt or the like extending about the periphery of an elongated traffic island dividing toll station traffic lanes. The belt is preferably driven at a variable selected speed under the control of personnel with a view of the traffic lane, the speed being in the range of from approximately one to twelve miles an hour. Means are provided for securing the automatic toll collectors to the belt at a plurality of positions, so that the intervals between adjacent automatic toll collectors is selectable.

The automatic toll collectors are highly similar to those currently in use except that the automatic toll collectors are provided with a large elongated toll-receiving hopper greatly increasing the target area for coins being deposited therein. Thus, the tolls can be deposited in the hopper easily despite the fact that both the vehicle and the automatic toll collector are moving. The hopper is fabricated of a flexible material so that it does not harm vehicles which may contact it. The hopper may be heated to prevent snow accumulation when used in northern areas.

A control arm unit including a control arm extending across the traffic lane may be secured to the moving belt ahead of each automated toll collector, and the control arm unit may include signalling means indicating the amount of the toll due, the receipt of the toll, or other information. The control arms are preferably pivotally mounted and raised so that they do not interfere with adjacent toll traffic lanes as the automated toll collectors and control arm units continue about the traffic island.

Because vehicles do not stop to pay tolls, the moving automated toll collectors permit a greater volume of traffic to pass through the single toll station traffic lane within a given period of time, thus decreasing or eliminating traffic tie-ups at the toll station. Several traffic lanes can be serviced by the moving automated toll collectors, although some manned toll booths are required to handle those vehicles without correct change.

Other and more specific objects and features of the invention herein will in part be obvious and will in part appear from a perusal of the following description of the preferred embodiment and the claims, taken together with the drawings.

DRAWINGS

The same reference numerals refer to the same elements throughout the various Figures.

DESCRIPTION OF PREFERRED EMBODIMENT

According to the invention herein, tolls are collected by moving automated toll collector apparatus, whereby vehicles do not stop at toll stations. Instead, the vehicles move through the toll stations at selected speed. This permits the toll stations to handle a higher volume of traffic, and decreases the possibility of traffic backups and their undesirable side effects.

Figure 1:
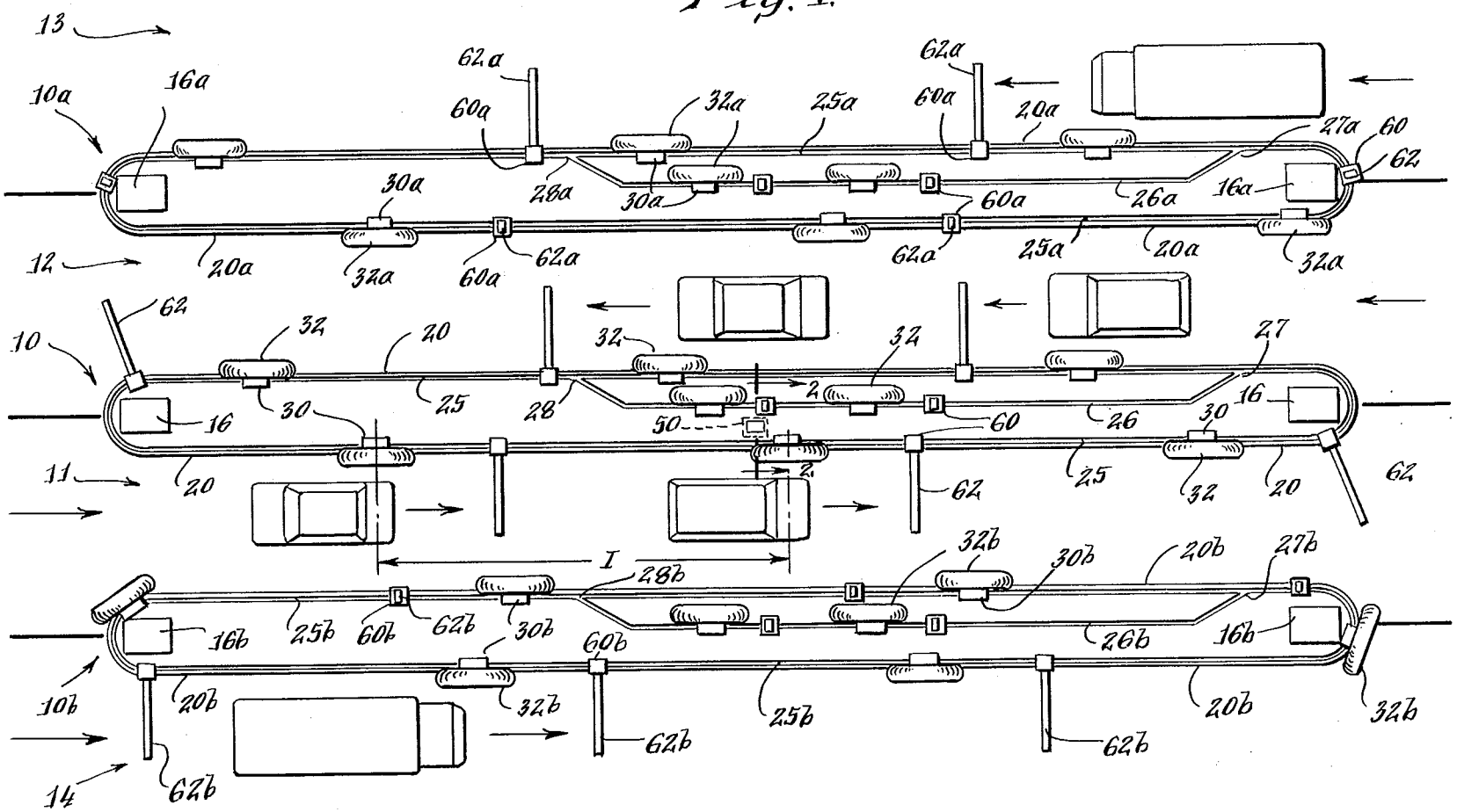
FIG. 1 is a top plan view of moving automated toll collector apparatus according to the invention herein comprising a portion of a toll station.

More particularly, with reference to FIG. 1 there is shown a portion of a toll station including moving automated toll collector apparatus 10 according to the invention herein. To better illustrate the invention herein, FIG. 1 shows two additional moving automated toll collector apparatuses, and the second and third moving automated toll collector apparatuses are designated 10*a* and 10*b*. It will be understood that they also comprise the elements of the moving automated toll collector apparatus 10, and where the elements are numbered they are given "a" and "b" suffixes.

The moving automated toll collector apparatus 10 preferably comprises an island 20 which is quite elongated, having a length of approximately 50 to 200 yards. The island 20 may be elevated from the road surface, and is positioned flanking and partially defining traffic lanes 11 and 12 through the toll station. The traffic island 20*a* of the moving automated toll collector apparatus 10*a* is positioned between the traffic lane 12 and an additional traffic lane 13, and the traffic island 20*b* of the moving automated toll collector apparatus 10*b* is positioned between the traffic lane 11 and a traffic lane 14. It will be appreciated that additional moving automated toll collector apparatus can be provided for additional traffic lanes, as desired and required.

The moving automated toll collector apparatus 10 further comprises a plurality of automatic toll collectors 30 and drive means generally designated at 40 for moving the automatic toll collectors 30 about the periphery of the island 20. The automatic toll collectors 30 are deployed at spaced apart selected intervals, e.g. the interval I which may be approximately four to five car lengths. The automatic toll collectors 30 are moved in a path parallel to and adjacent the traffic lane 11 on one side of the traffic island 20, and in a path parallel to and adjacent the traffic lane 12 on the other side of the traffic island 20. Control arm units 60, preferably including signal means as more fully discussed below, may be mounted to the drive means 40 at points slightly ahead of each automatic toll collector 30.

Figures 2, 3, 4:
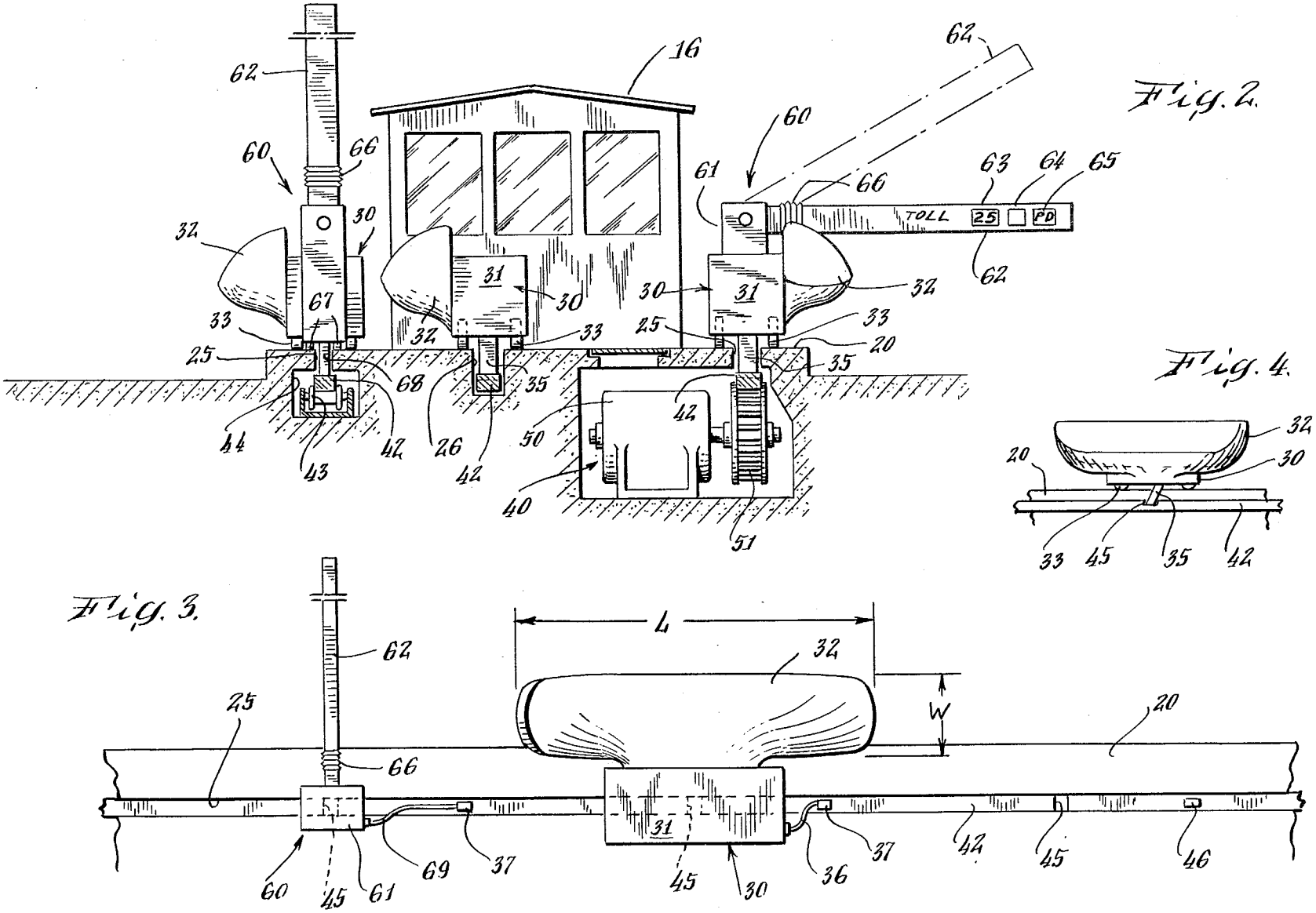
FIG. 2 is a sectional view of the moving automated toll collector apparatus of FIG. 1 taken along the lines 2—2 of FIG. 1.
FIG. 3 is a top view of one of the moving automated toll collectors of the moving automated toll collector apparatus of FIG. 1.
FIG. 4 is a side view of one of the moving automated toll collectors of the moving automated toll collector apparatus of FIG. 1.

Each automatic toll collector 30 functions to receive tolls paid in coinage and provide a signal when the toll is received. The automatic toll collector 30 comprises a housing portion 31 which encloses the coin counting and signal providing means, which are the same internally as automatic toll collectors already in use in stationary locations and need not be described further. A hopper 32 is mounted to the housing 31 and extends outwardly therefrom to be positioned partially in a traffic lane. The hopper is very large, being on the order of five to ten feet in length L and one and one-half to three feet in width W, as seen in FIG. 3. This provides a large target area for receiving coins in payment of tolls. The hopper is appropriately shaped to direct the coins into the coin counting means in the housing 31. The hopper 32 is preferably fabricated of a flexible material, such as a synthetic rubber or a plastic, wherein the hopper can be contacted by vehicles without harming the vehicles.

As best seen in FIGS. 2 and 4, the housing 31 of the automatic toll collector 30 is mounted on a plurality of wheels 33, wherein the automatic toll collector 30 is adapted for rolling movement. A leg 35 extends downwardly from the underside of the housing 31, and the leg 35 cooperates with the drive means 40, as will be further discussed below. A power/signal cord 36 provided with a plug connector 37 is used to provide electrical power to the automatic toll collector 30 and to exchange signals therewith. It will be appreciated that the automatic toll collector 30 can also be provided with a transceiver for exchanging signals, if desired, and could further be battery powered thereby eliminating the need for a power/signal cord and plug connector.

The control arm units 60 function to inform the amount of the toll due, to indicate receipt of the toll and to maintain spacing between vehicles using the moving automated toll collector apparatus 10. Each control arm unit 60 generally comprises a housing 61 to which a control arm 62 is pivotally mounted. The control arm 62 has signs and indicators providing the usual information given to vehicles at toll stations, e.g. signs 63 and 64 which light to indicate the amount of toll due and sign 65 which lights to indicate that the toll has been paid. These signs can be provided on the housing 61 of the control arm units 60 instead of on the control arm 62, if desired. The control arm 62 preferably has a flexible section 66, such that the control arm yields if struck or contacted by a vehicle.

The housing 61 encloses a motor and controls for raising and lowering the control arm 62. The housing 61 is mounted on wheels 67, adapting the control arm unit 60 for rolling movement. A depending leg 68 extends downwardly from the housing 61, and the leg 68 cooperates with the drive means 40, as more fully described below. The control arm unit 60 further comprises a power/signal cord and connector assembly 69, for exchanging power and signals to the control arm unit 60. As noted above with respect to the automated toll collectors 30, transceivers and battery power are alternatives.

The drive means 40 comprises a flexible belt 42 supported on rollers 43 or the like in a tunnel-like space 44 under the periphery of traffic island 20. The flexible belt 42 is positioned under a guide slot 25 defined by the traffic island 20, the guide slot 25 being parallel to the edges of the island 20 adjacent the traffic lanes 11 and 12 and having curved ends providing for a transition from one edge to the other edge of the traffic island 20. The guide slot 25 extends from the surface of the traffic island to the tunnel 44, and the flexible belt 42 is positioned under the guide slot 25.

The flexible belt 42 is driven by a variable speed motor 50 through a drive pulley 51, which may be cogged with the belt 42 having mating cogs on the underside thereof for a positive drive connection. The speed at which the belt is driven is controlled manually by toll station personnel, and the controls may conveniently be provided in control booths 16 provided on the traffic island 20 where personnel can have a view of the toll collection process. The upper side of the flexible belt 42 includes connectors such as connector 46 which receive the plug connectors of the automated toll collectors 30 and control arm units 60. Power and signal exchange with the flexible belt is provided by slide contacts or the like, not shown but well known, and wires in the flexible belt terminate at the plug connectors.

The upper surface of the flexible belt 42 is also provided with notches 45 adapted to receive and engage with the depending legs of the automatic toll collectors 30 and the control arm units 60. It will be appreciated that there are more notches 45 and plug connectors 46 on the flexible belt 42 than there are automatic toll collectors 30 and control arm units 60, so that the automatic toll collectors 30 and control arm units 60 can be spaced at selected intervals along the flexible belt 42. A sliding guide slot 26 intersects with the main guide slot 25, as indicated at 27 and 28, the siding guide slot providing storage for automatic toll collectors and control arm units not in use. They can be reinserted onto the flexible belt 42 at the end 28 of the siding guide slot 26, where it joins with the main guide slot 25. With reference to the automatic toll collector apparatus 10*a* shown at the left of FIG. 1, the spacing between the automatic toll collectors 30 has been increased to accommodate large vehicles, such as trucks.

In the preferred and fastest mode of operation, the automatic toll collectors 30 and control arm units 60 are engaged with the flexible belt 42, a control arm unit 60 being positioned ahead of each automatic toll collector 30. The flexible belt 42 is driven by the motor 50 at a selected desired speed, which is preferably in the range of approximately one to ten or twelve miles an hour. Thus, the automatic toll collectors 30 preceded by the control arm units 60 are driven along the guide slot 25 surrounding the traffic island 20, and the hoppers 32 of the automatic toll collectors are presented to traffic lanes 11 and 12.

Tolls are collected in traffic lane 11 from vehicles proceeding in the direction of the arrow at the side of FIG. 1 and the automatic toll collectors are driven in a counterclockwise direction about the traffic island 20. Vehicles enter the traffic lane 11 behind a control arm unit 60, and position themselves adjacent the hopper 32 of one of the automatic toll collectors 30. The control arm unit 60 displays the amount of toll due on one of the signs 63 or 64, and the toll is deposited from the vehicle into the hopper 32. This occurs while the vehicle is moving through the traffic lane 11 adjacent the automatic toll collector 30 at the speed of the automatic toll collector 30, e.g. approximately ten miles an hour. Once the automatic toll collector 30 has received the toll, it so signals and the signal is carried to the preceeding control arm unit 60, wherein the sign 65 on the control arm 62 indicates that the toll is paid. It is not desirable to raise the control arm 62 at this point, but rather to leave the control arm 62 down to maintain vehicle spacing. However, personnel in the control booth 16 at the end of the traffic island 20 can observe whether the toll has been paid or not paid as the vehicle passes from the traffic lane 11.

In the situation wherein the traffic lane 12 on the opposite side of the island 20 has traffic flowing in the direction opposite from traffic lane 11, as is illustrated in FIG. 1, the control arms 62 may remain down and the automatic toll collectors 30 and control arm units 60 operate in the manner described above to collect tolls from vehicles passing through the traffic lane 12. However, with respect to the moving automated toll collector apparatus 10*a*, signal means are provided to raise the control arms 62 as they pass from traffic lane 13 to traffic lane 12, so that as the automatic toll collectors 30*a* and control arm units 60*a* return on the opposite side of the island 20*a*, the control arms will be up and not interfere with oncoming traffic.

It will be appreciated that the speed at which the automatic toll collectors are driven can be adjusted until a smooth flow of traffic is achieved through the traffic lanes. It will further be appreciated that in periods of low traffic volume, the automatic toll collectors can remain stationary and collect tolls in the usual manner. Also, the direction of movement of the automated toll collectors about the traffic island can be reversed, whereby the tolls are collected from vehicles moving in the opposite direction, so that the maximum toll collecting capacity can be utilized in the direction of heavier traffic flow.

Although not shown in FIG. 1, in a typical toll station there will also be traffic lanes serviced by manned toll booths, wherein vehicles not having the proper change can be accommodated.

The principal feature of the moving automated toll collector apparatus according to the invention herein is that automated toll collectors are driven in paths adjacent a toll station traffic lane, wherein vehicles are kept moving through the toll station. Accordingly, the particular drive means for the automatic toll collectors may be substantially different from that described above. Other changes may be made in the preferred embodiment without departing from the spirit and scope of the invention herein, which is limited only by the following claims.

I claim:

1. Moving automated toll collector apparatus comprising a plurality of automated toll collectors each having a hopper for receiving coins in the amount of a toll; and drive means moving the automated toll collectors at spaced apart intervals in a path parallel to and adjacent a traffic lane in which tolls are to be collected whereby a vehicle entering the traffic lane positions itself adjacent the hopper of one of the automated toll collectors, deposits the toll and departs the traffic lane without having stopped.

2. Moving automated toll collector apparatus as defined in claim 1 wherein the drive means moves the automated toll collectors at a selected speed in the range from one to twelve miles an hour.

3. Moving automated toll collector apparatus as defined in claim 1 wherein the drive means moves the automated toll collectors in a closed loop including as a portion thereof the path parallel to and adjacent the traffic lane in which tolls are to be collected.

4. Moving automated toll collector apparatus as defined in claim 3 wherein the automated toll collectors are each removably secured to the drive means and the intervals between the automated toll collectors can be selected by selecting the number of automated toll collectors secured to the drive means and selecting their positions on the drive means.

5. Moving automated toll collector apparatus as defined in claim 1 wherein the hopper of each automated toll collector is fabricated of a flexible material which yields if contacted by a vehicle to prevent damage to the vehicle.

6. Moving automated toll collector apparatus as defined in claim 5 wherein the hopper has a length in the range of five to ten feet and a width in the range of one and one-half to three feet.

7. Moving automated toll collector apparatus as defined in claim 5 wherein the automated toll collectors are each removably secured to the drive means and the intervals between the automated toll collectors can be selected by selecting the number of automated toll collectors secured to the drive means and selecting their positions on the drive means.

8. Moving automated toll collector apparatus as defined in claim 7 wherein the drive means moves the automated toll collectors in a closed loop including as a portion thereof the path parallel to and adjacent the traffic lane in which tolls are to be collected.

9. Moving automated toll collector apparatus as defined in claim 6 wherein the drive means includes a motor driven flexible belt to which the automated toll collectors are removably secured.

10. Moving automated toll collector apparatus as defined in claim 9 wherein the moving automated toll collector apparatus is deployed on an elongated traffic island separating two adjacent traffic lanes, the traffic island defining a guide slot about the periphery thereof with the motor driven flexible belt disposed under the guide slot, the automated toll collectors being mounted on wheels for rolling movement and having a depending leg extending into the guide slot and engaging with the drive belt.

11. Moving automated toll collector apparatus as defined in claim 10 wherein a siding guide slot intersects the guide slot surrounding the periphery of the traffic island, the siding guide slot receiving the depending legs of automated toll collectors removed from the motor-driven flexible belt.

12. Moving automated toll collector apparatus as defined in claim 11 and further comprising a plurality of control arm units including a control arm for extending across the traffic lane, one control arm unit being mounted adjacent and ahead of each automated toll collector.

13. Moving automated toll collector apparatus as defined in claim 12 wherein the control arm units include sign displays indicating the amount of the toll due.

14. Moving automated toll collector apparatus as defined in claim 13 wherein each automated toll collector provides a signal when it receives a toll and the preceding control arm unit receives the signal and provides a visual display indicating that the toll has been received.

15. Moving automated toll collector apparatus as defined in claim 10 wherein the control arms of the control arm units each include a flexible portion whereby the control arms yield if contacted by a vehicle to prevent damage to the vehicle.

16. Moving automated toll collector apparatus as defined in claim 1 and further comprising a plurality of control arm units including a control arm for extending across the traffic lane, one control arm unit being mounted adjacent and ahead of each automated toll collector.

17. Moving automated toll collector apparatus as defined in claim 16 wherein the control arm units include sign displays indicating the amount of the toll due.

18. Moving automated toll collector apparatus as defined in claim 17 wherein each automated toll collector provides a signal when it receives a toll and the preceding control arm unit receives the signal and provides a visual display indicating that the toll has been received.

19. Moving automated toll collector apparatus as defined in claim 16 wherein the control arms of the control arm units each include a flexible portion whereby the control arms yield if contacted by a vehicle to prevent damage to the vehicle.

* * * * *